United States Patent [19]

Spaude et al.

[11] 4,021,992

[45] May 10, 1977

[54] IN-LINE SYSTEM OF PACKAGING, SECURING, AND WEIGHING

[75] Inventors: Walter Charles Spaude, Milwaukee; Thomas Duane Wichman, Franksville; Michael Thomas Corrigan; Jimmie Carl Joannon, both of Racine, all of Wis.

[73] Assignee: J. I. Case Company, Racine, Wis.

[22] Filed: July 6, 1976

[21] Appl. No.: 702,480

[52] U.S. Cl. ..... 53/3; 53/59 W

[51] Int. Cl.[2] ..... B65B 13/02

[58] Field of Search ..... 53/3, 53, 59 W, 390

[56] References Cited

UNITED STATES PATENTS 3,244,278 4/1966 Werpin et al. ..... 53/59 W X

*Primary Examiner*—Othell M. Simpson

*Assistant Examiner*—J. Sipos

*Attorney, Agent, or Firm*—Arthur J. Hansmann

[57] ABSTRACT

An in-line system of packaging, securing, and weighing items which are originally collected in a tote pan and delivered to a packaging bench where they are placed into a container and then onto a conveyor which moves them to a first photo-electric eye and weighing scale. The containers are then either removed at that point or are passed along a second conveyor and to a second photoeye and weighing scale, and those containers may be banded or wrapped and are then set off for shipping. The entire system is an in-line system where the containers move along in a supported arrangement on a conveyor and need not be removed from the conveyor until the containers are ready for shipping and they have therefore been packaged, secured by banding or the like, weighed, postage applied, and the like.

6 Claims, 1 Drawing Figure

IN-LINE SYSTEM OF PACKAGING, SECURING, AND WEIGHING

This invention relates to an in-line system of packaging, securing, and weighing items, and it is particularly useful in a parts supply system where different orders are being filled for various parts of machines or the like, and the parts are placed into a container and are then processed to a final form for shipping.

BACKGROUND OF THE INVENTION

Industry is confronted with and aware of the problem of filling orders for parts which are obtained from numerous supply shelves and which must be packaged and fully prepared for shipping. The problems attending these necessary functions include the overall efficiency of that type of work, and it is important that the work be rapidly accomplished so that the orders are not unnecessarily delayed, and it is also important that the work be performed by the fewest number of employees who are completely familiar with the nature of the system and its operations. Accordingly, the primary objectives of this invention are to accomplish the aforementioned and to do so with an in-line type of system for filling orders for parts or the like.

The present invention further provides for the aforementioned system wherein the following several desirable results can be accomplished:

1. The number of operators can be in accordance with the current requirements for the number of packages being handled by the system, such that, during slower demand periods, the entire system can be operated by only a single operator, and, during peak demand periods, the entire system can be operated by only several operators.

2. Smaller packages, such as those which can be shipped through postal service or parcel post services can be intercepted from the in-line system and be removed therefrom for special and separate handling apart from the larger packages, and, as such, the smaller packages can be separated from the other packages for the shipment by the postal means available while the other packages can be processed for shipment by bus or truck or air freight or the like.

3. Only a minimum of floor space is required for installation and performance of the entire system, and this is accomplished in part by having a U-shaped so-called in-line system which moves the packages around the U-shape, and an operator can conveniently locate himself at various stations on the interior of the U-shaped configuration.

4. The system also provides for the processing of packages at a rate which can be adjusted according to the efficiencies and speeds of action of the operator or operators, and, as such, the system can actually provide for temporary detention of the packages in the in-line system, until the operator or operators are ready to process the next package.

5. Packages processed in this in-line system need not be lifted by the operator while the package is being processed through the system, and the lifting occurs only when the package is placed onto and removed from the in-line system itself, as such, each package is completely processed through arrangement of items within the package or container, sealing and weighing and affixing postage and labeling, all for final sending or shipping of the completed package, before it is removed from the in-line system.

Other objects and advantages will become apparent upon reading the following description in light of the accompanying drawing.

DETAILED DESCRIPTION OF THE PREFERRED EMBODIMENT

Figure 1:
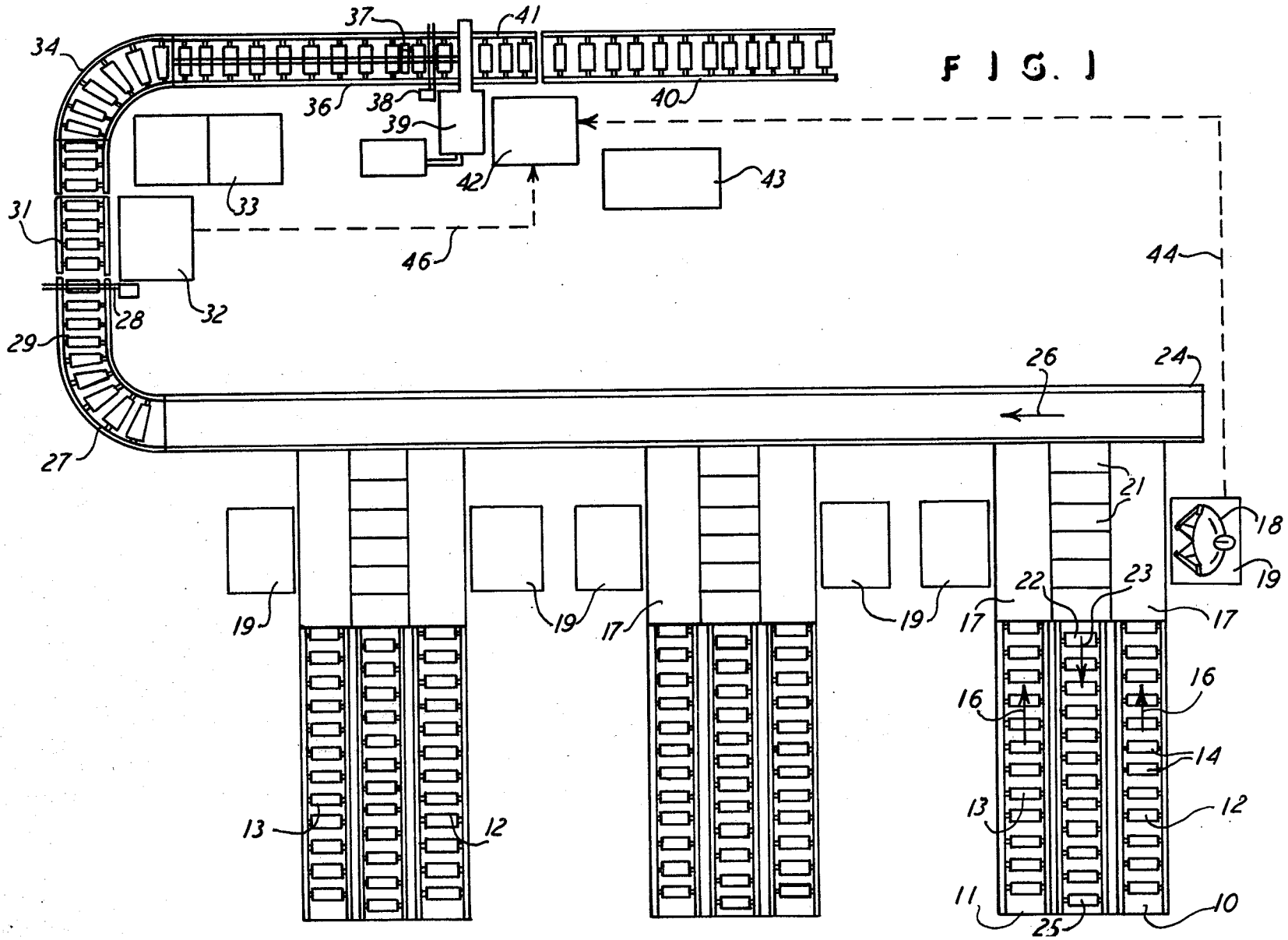
FIG. 1 is a top plan view of the apparatus, and also showing the nature of the method, of this invention.

The drawings show the apparatus used in this system, and both the apparatus and the process are fully disclosed in this Specification, and the process and its steps and full procedure will become apparent upon the reading of the Specification, with reference to the drawing. Accordingly, the drawing shows a plan view of the apparatus utilized in carrying out this invention, and it will be understood that the items to be packaged may be supply parts, such as useful for farm machinery or any other parts or items of other nature, and workers would obtain the parts in tote pans or the like and bring them to the entryways designated 10 and 11. The drawings show gravity conveyors 12 and 13, in the form of roller-type conveyors having the rollers 14, and the worker would place the tote pan or the like, with the parts therein, at the beginning or entranceways 10 and 11, and the pans would move along the conveyors 12 and 13, in the direction of the arrows 16, and the conveyors 12 and 13 extend to and terminate at benches 17.

The drawing further shows a packing employee or operator 18 who is at a station designated 19 and who would receive the loaded tote pans on the bench 17 and he would place the parts into an appropriate carton or other container. The supplies needed by the operator 18 are stored on the shelves or risers designated 21, and the operator can place the emptied tote pan onto a gravity conveyor 22 which moves the tote pan in the direction of the arrow 23 and back to the conveyor end 25 where the tote pans again can be picked up and reloaded, as desired. Also, after the operator 18 packages the parts in a carton or like container, the packaged container is placed onto a belt-type conveyor 24 which operates in the direction of the arrow designated 26.

It will be seen that there are several operator stations 19, and each is positioned adjacent the tote pan incoming conveyors 12 and 13, and three such groupings or banks of conveyors 12 and 13 and conveyor 14 are shown, and they all feed and are disposed and arranged relative to the conveyor 24 such that six operators 18 and their respective stations 19 can be receiving a stream of tote pans and can place the parts into a carton and package the parts and place them on the belt conveyor 24.

At this time it will be seen, and it will be understood by anyone of skill in the art, that the conveyor 24 extends adjacent to and past the tote pan feeding conveyors 12 and 13 and the respective benches 17, and the conveyor extends to other conveyor sections described hereinafter, such that all of the conveyors extend in a U-shape, as seen in FIG. 1, and they are on one floor level and therefore occupy only a minimum of floor space and are convenient and accessible for servicing by one or only a few operators who control the movement of the packages along the conveyors shown and in the manner described hereinafter. As such, the entire system is an in-line type of system, and the packages will not be again lifted by an operator until they are finally removed from the very end of the U-shaped conveyors shown, and, in that process the items are packaged and are weighed, and postage is applied, and the packages are labeled, and they are banded and larger packages are weighed, and finally the packages are removed from the conveyors and ready for shipment by a selective mode of transportation.

The packaged containers then proceed on the conveyor 24 and around the conveyor section designated 27 and to the path of a photo-electric eye designated 28. The eye 28 is of a conventional arrangement, and it is also conventionally operationally connected with the conveyor 24 for actuating the conveyor in accordance with the speed and frequency of the containers arriving at the path of the photo-electric eye 28 which is across the conveyor at the section designated 29 and as indicated in the drawing. If the conveyor is stopped, by the interconnection with the photo eye 28 in a usual and any well known arrangement, then the containers will of course accumulate, in the manner of providing and operating an accumulating conveyor.

A first weighing scale designated 31 is in container-flow or movement communication with the conveyor section 29, and it receives the containers which can therefore be weighed at the first scale 31. The drawing further shows an operator's station 32 adjacent the scale 31, and the operator can then detect whether or not the containers are of a small size or lightweight which will be conducive to shipping the containers by parcel post or the like, and those small containers can then be removed from the in-line system by the operator at the station 32. Also, the system includes an automatic postage machine and labeling device designated 33, of a conventional construction, and the packages can be processed by this apparatus 33, and the packages are then completely ready for the shipment mentioned.

The remaining containers, which are of a larger size, continue along a conveyor curve section 34, and they move to a conveyor accumulating type section 36 which has a manual control type of stop 37 movable into the path of the containers for accumulating them on the accumulating conveyor 36, in a conventional arrangement. Also, a second photo eye 38 is arranged and located at the end of the conveyor 36 and has its effective operating path extending across the conveyor for detecting the passage of containers there-past, in the usual arrangement, and the photo eye 38 can operate the stop 37 which is therefore also interconnected with the eye 38 and automatically operated when it is desired not to have the manual stopping or operation of the stop 37. Also, a bander 39 is provided at the end of the accumulating conveyor 36, and the bander will serve to secure or tie the containers as they pass through the location of the bander 39 which is of a conventional construction and thereby operates in the usual manner. In accomplishing the movement of the packages around the conveyor curve 34, the operator at the station 32 could simply push the packages along the roller-type conveyor shown, and the packages would simply move onto the accumulating conveyor 36 and to the conventional apparatus 37 and 38 and 39 at the end of the powered accumulating conveyor 36, as described.

A second weighing scale 41 is in container-flow communication with the conveyor 36, and there is also an operator station 42 adjacent the scale 41, and the operator can then weigh the containers while they are on the scale 41, and such weight can be noted on the containers. Finally, the packages move onto the conveyor section 40 which is in container-flow communication with the scale 41, and the operator will simply only push the packages over to the conveyor 40 where the packages can be stored and ultimately removed and placed onto a table 43 or the like for the bus, truck, air freight, or like handling as mentioned with regard to the so-called other or remaining containers which are not removed at the first scale 31.

In the aforementioned description of both the apparatus and the method and its individual and particular steps, it will also be seen that the operator 18 can move along the dotted line 44 and go to the station 42, and he can also readily move to the station 32. That is, when there is only a low demand for productivity of final packaging, one operator can handle the entire apparatus, and the U-shaped arrangment of the conveyor sections mentioned readily and easily provide for the control of the entire apparatus and the entire method, by only one operator. Of course there could be an operator at each of the stations 19 and the stations 32 and 42, when the demand for productivity requires same. Of course if there is only one operator, then he can operate the stop 37 manually, and he can then permit the packages to move off the accumulating conveyor 36 in accordance with the speed at which he can handle the packages for the weighing at the station 42 and for like operator functions which have been mentioned. Conversely, if the stop 37 is not manually controlled, then it is controlled by the photo eye 38 which is operatively interconnected with the stop 37 and which therefore suitably operates the stop 37 for feeding the containers through the bander 39 and onto the scale 41, and such interconnection of the parts can be in a conventional manner, and the description herein sufficiently describes the method and process steps, as well as the apparatus being utilized.

In summary, the entire system has the following features and advantages:

1. It is completely flexible with regard to demand volume, because of the accumulating functions of the conveyor prior to each of the weighing operations described.

2. Because of the U-shaped configuration of the conveyors, the entire apparatus and system is accomplished with a minimum of floor space.

3. It utilizes an in-line system where the containers continuously move through the system without being lifted therefrom until the very end of their journey.

4. It utilizes a single level conveyor, in a single line, and it has a multiple mode of conveying for creating efficiency of movement as well as considerable cost savings.

5. The use of the belt conveyor 24 permits the handling of small packages and avoids the wedging or falling of small packages between rollers of a roller-type conveyor of a standard arrangement.

6. The conveyors 10 and 11 and 22 all provide for an in-processed storage of parts and empty tote pans.

7. The final conveyor section 40 provides for storage or accumulation of completed large packages or containers, and they may be removed when convenient.

8. The entire system is customer-oriented to process emergency orders in the shortest of time.

As such, it will be seen and understood that the conveyor curved section 27 is of a tapered roller curve and is powered, and the photo eye 28 is arranged and wired to control both the conveyor 24 and the conveyor 27, in a conventional interconnected relationship. Also, the scale section 31 includes the apparatus for automatic calculation of postage, and weight, and label printout, in conventional equipment. As indicated, the conveyor section 34 is a gravity type, and the section 36 is an accumulating power type. Where the operator has manually utilized the stop 37, he would undoubtedly then be operating between stations 32 and 42, and his path of movement would be as shown by the dotted line designated 46.

What is claimed is:

1. A method of packaging, securing, and weighing items in various containers, comprising the steps of placing said items in respective containers at a packaging station, moving said containers along an in-line system in a continuously apparatus-supported manner by operating and arranging a first conveyor to extend from said station and to a location remote from said station and to a location across the operating path of a first photo-electric eye arranged to be operatively associated with and for operation of said first conveyor, placing said containers on said first conveyor for movement to said first photo-electric eye path, operating and arranging a first weighing scale in container-flow communication with said first container and adjacent to said photo-electric eye, weighing said containers on said first scale and marking the weight thereon and selectively removing some of said containers from said in-line system and passing other of said containers along said system, operating and arranging a second conveyor in continuous apparatus-supported container-movement communication with said first scale to extend from said first scale and to a location remote from said first scale and to a location across the operating path of a second photo-electric eye arranged to be operatively associated with and for operation of said second conveyor, placing said other containers on said second conveyor and arranging for movement of said other containers along said in-line system to said second photo-elctric eye path, banding said other containers, operating and arranging a second weighing scale in container-flow communication with said second conveyor and adjacent to said second photo-electric eye, and weighing the banded said other containers on said second scale and marking the weight thereon.

2. The method of packaging, securing, and weighing items in various containers, as claimed in claim 1, including the step of affixing shipping postage to said some containers.

3. The method of packaging, securing, and weighing items in various containers, as claimed in claim 1, including the step of arranging said first and said second conveyors in a U-shape pattern for accessibility to a person moving within the configuration of said pattern.

4. The method of packaging, securing, and weighing items in various containers, as claimed in claim 1, including the step of arranging and operating a container stop in the path of said second conveyor and adjacent said second scale, and accumulating said other containers on said second conveyor.

5. The method of packaging, securing, and weighing items in various containers, as claimed in claim 1, including the initial step of placing said items in a tote member and transporting said member to said packaging station for packaging.

6. The method of packaging, securing, and weighing items in various containers, as claimed in claim 1, including the step of feeding containers onto said first conveyor at a plurality of locations spaced along said first conveyor, for effecting multiple feed lines of said containers for said first conveyor.

* * * * *